US007303078B2

(12) United States Patent
Ekholm et al.

(10) Patent No.: US 7,303,078 B2
(45) Date of Patent: Dec. 4, 2007

(54) SCREEN PANEL

(75) Inventors: Michael Ekholm, Minneapolis, MN (US); Sabin Bajracharya, St. Louis Park, MN (US); Steve R. Boettner, Stacy, MN (US); Charles H. Flansburg, Andover, MN (US); Gerald Allan Berry, Elk River, MN (US)

(73) Assignee: Weatherford/Lamb, Inc., Houston, TX (US)

( * ) Notice: Subject to any disclaimer, the term of this patent is extended or adjusted under 35 U.S.C. 154(b) by 256 days.

(21) Appl. No.: 10/448,747

(22) Filed: May 30, 2003

(65) Prior Publication Data

US 2004/0238413 A1 Dec. 2, 2004

(51) Int. Cl.
*B07B 1/46* (2006.01)
*F21S 8/00* (2006.01)

(52) U.S. Cl. ..... 209/393; 209/400; 362/145

(58) Field of Classification Search ..... 209/393, 209/394, 395, 400; 166/234, 235; 40/546; 362/145, 152; 126/167, 179; 4/1.406, 5.906
See application file for complete search history.

(56) References Cited

U.S. PATENT DOCUMENTS

| | | | | |
|---|---|---|---|---|
| 308,176 | A * | 11/1884 | Kruse | 126/181 |
| 2,281,326 | A * | 4/1942 | Records | 166/234 |
| 2,288,883 | A * | 7/1942 | Bixby | 209/393 |
| 2,512,954 | A * | 6/1950 | Marks | 119/841 |
| 2,825,796 | A * | 3/1958 | Lammon | 362/152 |
| 3,980,555 | A | 9/1976 | Freissle | |
| 4,100,248 | A | 7/1978 | Adams | |
| 4,193,503 | A * | 3/1980 | Connolly | 209/393 |
| 4,374,169 | A | 2/1983 | Gryskiewicz et al. | |
| 4,657,079 | A | 4/1987 | Nagaoka | |
| 4,742,872 | A | 5/1988 | Geske | |
| 4,818,403 | A | 4/1989 | Nagaoka | |
| 4,832,834 | A | 5/1989 | Baird, Jr. | |
| 4,855,040 | A | 8/1989 | Kickuth | |
| 4,960,510 | A | 10/1990 | Wolff | |
| 5,045,184 | A | 9/1991 | Arkles | |
| 5,246,158 | A | 9/1993 | Nagaoka et al. | |
| 5,255,790 | A * | 10/1993 | Einoder et al. | 209/393 |

(Continued)

FOREIGN PATENT DOCUMENTS

| | | |
|---|---|---|
| AU | 707009 | 1/1999 |

(Continued)

OTHER PUBLICATIONS

PCT International Search Report, International Application No. PCT/GB 03/00787, dated Jun. 4, 1003.

(Continued)

*Primary Examiner*—Joseph Rodriguez
(74) *Attorney, Agent, or Firm*—Patterson & Sheridan, LLP

(57) ABSTRACT

A method and apparatus for altering the reflectivity of a screen when light is supplied to a portion of the screen is disclosed. The orientation and shape of wires disposed on at least one bar of the screen is controlled to alter the reflectivity of the screen. Also provided is a method and apparatus for supporting a screen on a surface such as a wall, including placing slots within the screen for mating with connecting members mounted on a support frame connected to the surface.

28 Claims, 9 Drawing Sheets

U.S. PATENT DOCUMENTS

| | | | | |
|---|---|---|---|---|
| 5,387,340 | A | 2/1995 | Ackerman | |
| 5,415,294 | A * | 5/1995 | Nagaoka | 209/393 |
| 5,472,095 | A * | 12/1995 | Malm | 209/303 |
| 5,687,853 | A | 11/1997 | Askew | |
| 6,095,338 | A * | 8/2000 | Connolly et al. | 209/274 |
| 6,793,360 | B2 * | 9/2004 | Goslee | 362/84 |
| 2002/0175120 | A1 | 11/2002 | Norell et al. | |
| 2002/0181229 | A1 * | 12/2002 | Wei | 362/147 |
| 2003/0168387 | A1 | 9/2003 | Maxson et al. | |

FOREIGN PATENT DOCUMENTS

| | | |
|---|---|---|
| EP | 0 548 910 A1 | 6/1993 |
| FR | 2 638 380 | 4/1990 |
| GB | 884432 | 12/1961 |
| GB | 2 179 987 | 3/1987 |
| WO | WO 99/00198 | 1/1999 |
| WO | WO 01/45867 | 6/2001 |

OTHER PUBLICATIONS

Endless Aperture, Elastomers Australia, Victoria, Australia, Issue No. 1, Jun. 1997.

PCT Partial Search Report, International Application No. PCT/US2004/015952, dated Dec. 17, 2004.

PCT Search Report, International Application No. PCT/US2004/015952, dated Mar. 14, 2005.

* cited by examiner

SCREEN PANEL

BACKGROUND OF THE INVENTION

1. Field of the Invention

Embodiments of the present invention generally relate to a screen panel for use in preventing certain substances from passing the screen panel, while permitting, other substances to penetrate the screen panel. More particularly, embodiments relate to a screen panel with aesthetically-pleasing reflectivity. More particularly, embodiments relate to an apparatus and method for mounting a screen panel to a surface.

2. Description of the Related Art

Flat screen panels are utilized in various capacities. The panels are useful to provide a barrier to unwanted material, yet screen panels are at the same time porous to permit desired substances such as air or water to travel therethrough. Screen panels are used to protect transformers or other electrical equipment used in buildings from debris which may interfere with the operation of the equipment and from tampering, while also allowing air flow through the screen panels so that the electrical equipment is simultaneously cooled. Screen panels are also used within water wells to permit water to travel through the screen panel, but prevent other debris from entering the interior of the screen panels; in the separation of liquids from solids; in general process filtration; and in the malting industry.

The fabrication of flat screen panels is accomplished by welding wires to bars (sometimes referred to as "rods") which extend along the length of the wires and are perpendicular to the wires. The bars structurally support the wires. The wires run parallel to one another, and the bars are also parallel to one another. At each intersection of the wires with the bars, the wires are welded to the bars. The bars as well as the wires are usually constructed of stainless steel, typically Type 304 stainless steel, to provide resistance to wear from abrasive substances to which the screen panels are often subjected.

Typically, the wires which are used to form the screen panels are triangular-shaped, or vee-shaped, in cross-section. The triangular-shaped wires are welded to bars to support the wires on the screen panel so that a pointed edge of the triangular cross-section is welded to the support bars at each intersection of the support bars with the wires. While the triangular-shaped wires perform the required functions of a screen panel, the aesthetic appearance of the screen panel is unremarkable. Furthermore, when attempting to angle the triangle-shaped wires with respect to the bars, it is difficult to control the angle due to the triangular cross-section of the wires.

Screen panels are often used to form a screen when employed for use around electrical equipment. The screen may include two screen panels, each having the perpendicular bars and wires. The two panels are connected, to one another by end supports at each end, so that the two panels form parallel and opposite sides of the rectangular-shaped screen and the end supports form the remaining parallel and opposite sides of the rectangular-shaped screen.

A typical installation of a screen panel to a surface such as a wall involves welding or bolting the screen panel to the surface. The screen panels are welded or bolted to the surface to provide structural support for the screens with respect to the surface as well as to provide a sealed perimeter around the screen panels to prevent unwanted debris from compromising screen performance. Screen panels mounted to the wall in this manner are not easily removable for cleaning or replacing. Furthermore, the welding or bolting of the screen panel to the surface requires a relatively lengthy installation process, increasing labor costs and time for installation of the screen panels.

Therefore, it is desirable to provide a screen which possesses reflectivity which is aesthetically pleasing. It is further desirable to provide an apparatus and method for conveniently mounting screen panels where the screen panels are easily installable and removable from the surface.

SUMMARY OF THE INVENTION

The present invention provides a decorative barrier which is porous for allowing flow of desired substances therethrough, while preventing the flow of undesired substances therethrough. The decorative barrier is achieved by altering the reflection of light within or on the screen panels due to the finish on the exposed surfaces of the wires and/or the orientation of the wires with respect to the bars. The present invention allows the reflectivity of the light to be easily altered by controlling the angles of the reflective surfaces of the wires with respect to the bars.

The present invention further provides removable screen panels for facilitating cleaning or replacing of individual panels. The removable panels advantageously allow for quicker installation of the screen panels to a surface, thus saving time and money during the installation process. The present invention advantageously provides an effective method of holding a screen panel in place while providing a perimeter seal to prevent compromise of screen performance.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
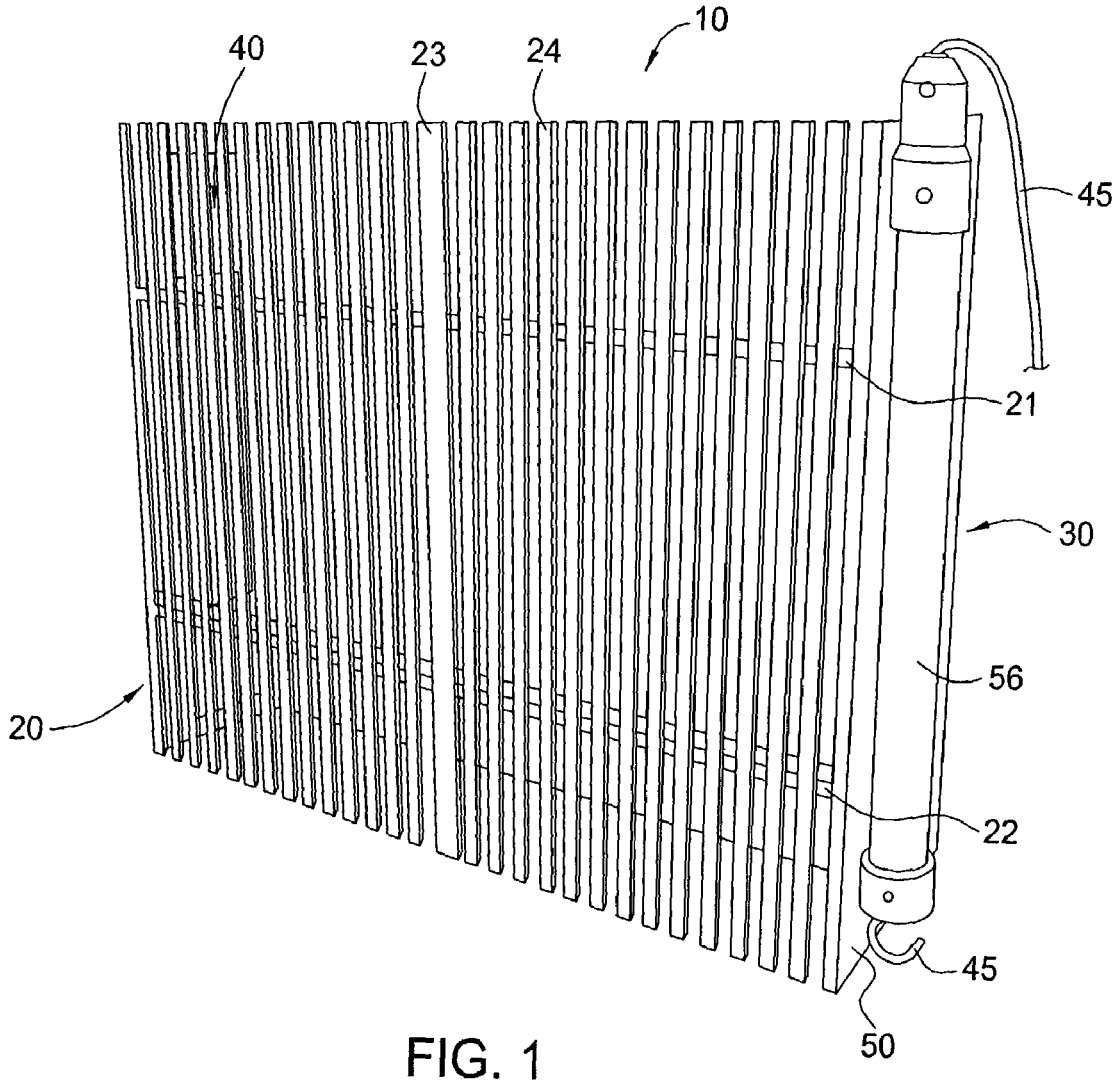
FIG. 1 is a sectional view of an architectural screen of the present invention.
Figure 2:
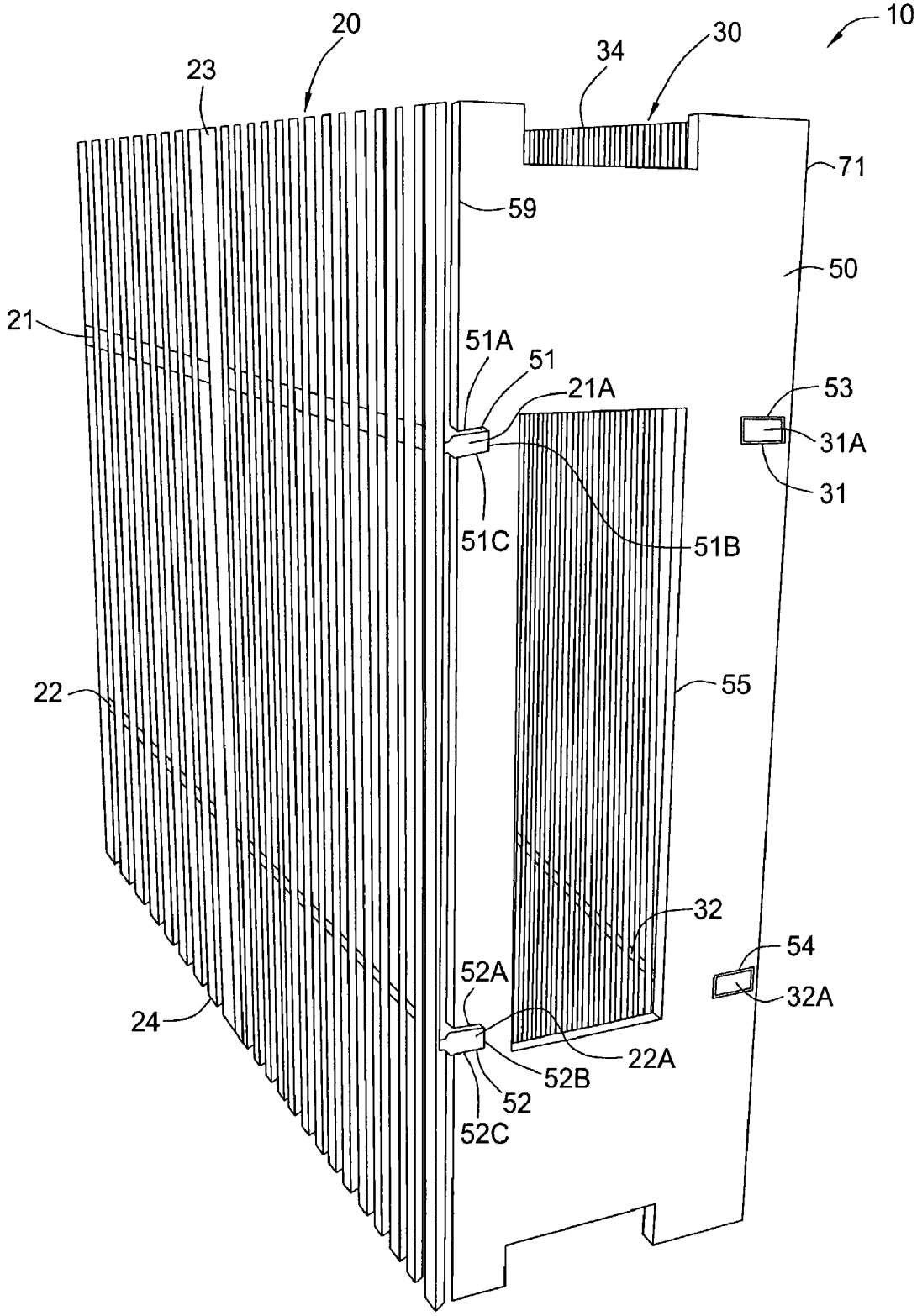
FIG. 2 is a side view of the screen of FIG. 1.

FIGS. 1-2 show a screen 10 of the present invention. The screen 10 is preferably constructed of stainless steel, but it is contemplated that other metals which demonstrate reflective properties may be utilized in constructing the screen 10. The screen 10 includes a front panel 20 and a back panel 30. The back panel 30 is closest to the disguised object (not shown), which may include electrical equipment, while the front panel 20 runs substantially parallel to the back panel 30 and is further away from the disguised object.

Figure 3:
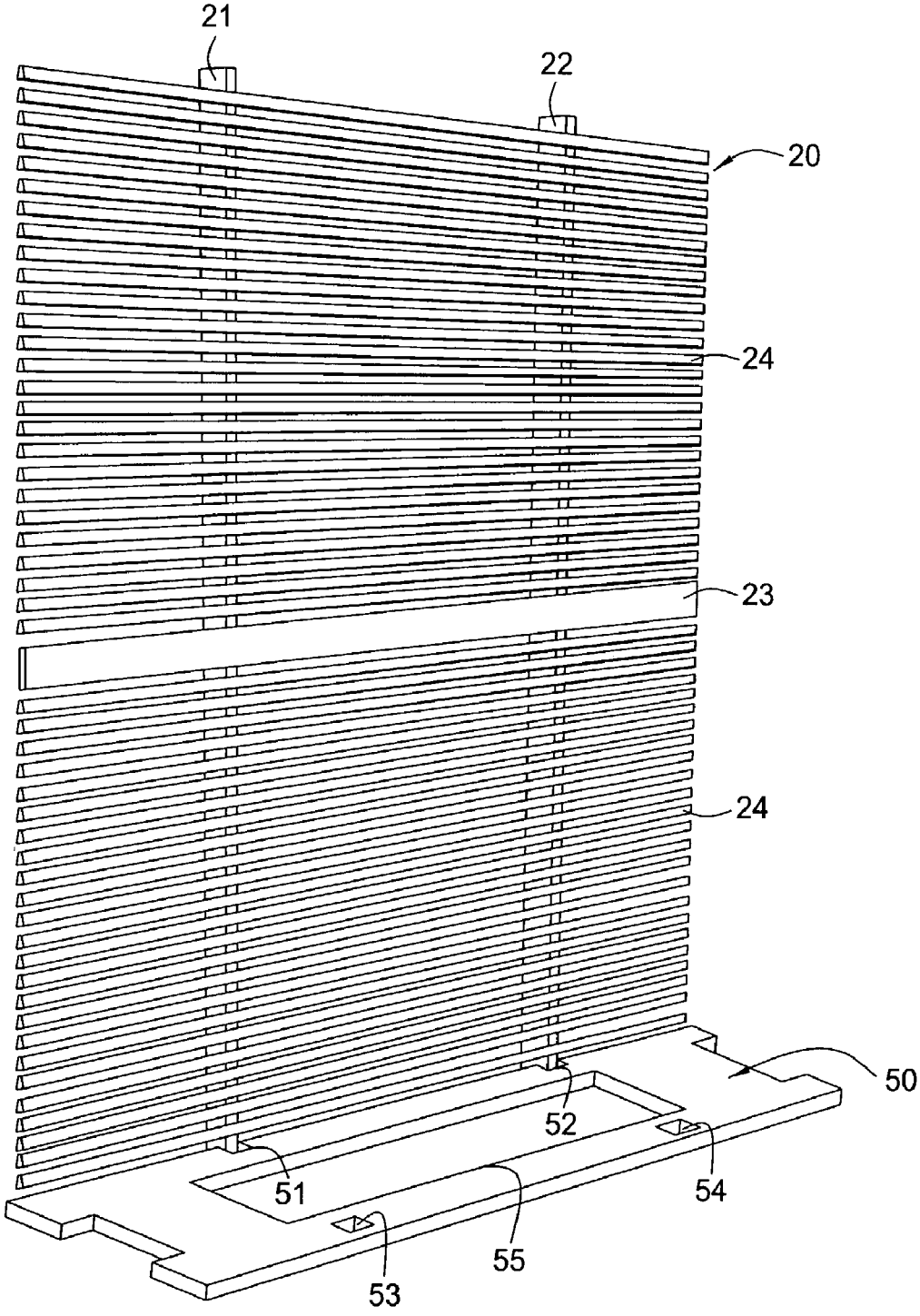
FIG. 3 is a sectional view of the front panel of the screen of FIG. 1.

Located on the left end of the screen 10 is a left end frame 40. On the right end of the screen 10 is a right end frame 50. FIG. 3 depicts the front panel 20 connected to the right end frame 50. The left end frame 40 and the right end frame 50 are substantially parallel to one another and substantially perpendicular to the front panel 20 and the back panel 30. The right end frame 50 has a light slot 55 disposed therein, while the left end frame 40 has a substantially similar light slot (not shown) disposed therein. The light slots 55 and (not shown) are shown as rectangular-shaped, but may be any shape which allows light to shine through the light slots 55 and (not shown) to the panels 20 and 30.

The right end frame 50 has a light emitter 56 running longitudinally along the right end frame 50. The light emitter 56 may be utilized to shine light through the light slot 55 to provide a reflective effect across the panels 20 and 30, or sunlight may be utilized in lieu of the light emitter 56 for the same purpose in some embodiments. The light emitter 56 is connected to the right end frame 50 above and below the light slot 55, so that the light emitter 56 is disposed substantially over the light slot 55 and emits light through the light slot 55. Similarly, the left end frame 40 may have a light emitter (not shown) running longitudinally along its length to allow light emission through its light slot (not shown). Both of the light emitters 56 and (not shown) are connected by wires 45 and (not shown) to one or more light sources (not shown) for providing light energy to the light emitters 56 and (not shown).

The right end frame 50 includes an upper front slot 51 and a lower front slot 52, and the upper front slot 51 and the lower front slot 52 are longitudinally in line with one another and parallel to one another along the right end frame 50. The upper front slot 51 and the lower front slot 52 extend to the edge of a front end 59 of the right end frame 50 so that the slots 51 and 52 are enclosed on three sides 51A, B, and C and 52A, B, and C. The front slots 51 and 52 are open at front end 59. The left end frame 40 has upper and lower front slots (not shown) which are enclosed on three sides and parallel to one another as well as longitudinally in line with one another located directly across from the upper and lower front slots 51 and 52 of the right end frame 50, as described above with regards to the right end frame 50. Preferably, the upper front slot of the left end frame 40 is located directly across the front panel 20 from the upper front slot 51, and the lower front slot of the left end frame 40 is likewise located directly across the front panel 20 from the lower front slot 52.

The right end frame 50 further includes an upper back slot 53 and a lower back slot 54 which are longitudinally aligned and parallel to one another. Unlike the upper and lower front slots 51 and 52, the upper and lower back slots 53 and 54 are enclosed on all four sides. The left end frame 40 also includes an upper back slot (not shown) and a lower back slot (not shown) which are longitudinally aligned and parallel to one another, as well as enclosed on all four sides. Preferably, the upper back slot of the left end frame 40 and the upper back slot 53 are located directly across the back panel 30 from one another, and the lower back slot of the left end frame 40 and the lower back slot 54 are also located directly across the back panel 30 from one another.

The front panel 20 has an upper bar 21 at its upper portion and a lower bar 22 at its lower portion. The upper and lower bars 21 and 22 are substantially perpendicular to the left and right end frames 40 and 50. A right end 21A of the upper bar 21 is disposed in the upper front slot 51 of the right end frame 50, while a left end (not shown) of the upper bar 21 is located in the upper front slot of the left end frame 40. A right end 22A of the lower bar 22 is disposed in the lower front slot 52, and a left end (not shown) of the lower bar 22 is disposed in the lower front slot of the left end frame 40. All of the ends 21A, (not shown), 22A, (not shown) of the bars 21-22 are enclosed by three sides 51A-C, (not shown), 52A-C, and (not shown) of their respective slots 51, (not shown), 52, and (not shown).

Connected to the front sides of the bars 21 and 22 are a plurality of wires 24. The wires 24 are preferably welded to the bars 21 and 22, but may be connected to the bars 21 and 22 by any other method known by those skilled in the art. The wires 24 are perpendicular to the bars 21 and 22 so that the bars 21 and 22 act as a support for the wires 24. Because the bars 21 and 22 are not completely enclosed by the upper and lower front slots 51, 52, and (not shown) of the right and left end frames 50 and 40, the wires 24 extend in front of the left end frame 40 and the right end frame 50. A support bar 23 is perpendicular to the bars 21 and 22 and connected to the bars 21 and 22 at some location between wires 24 to support the front panel 20 over the length of the bars 21 and 22. The support bar 23 is preferably substantially rectangular, but it is contemplated to take other shapes also.

Similar to the front panel 20, the back panel 30 has an upper bar 31 with right and left ends 31A and (not shown), respectively, as well as a lower bar 32 with right and left ends 32A and (not shown), respectively. The upper bar 31 and lower bar 32 run substantially perpendicular to the left end frame 40 and right end frame 50, and the upper bar 31 is above the lower bar 32. The left end (not shown) of the upper bar 31 is located within the upper back slot of the left end panel 40, while the right end 31A of the upper bar 31 is located within the upper back slot 53. The left end (not shown) of the lower bar 32 is located within the lower back slot of the left end panel 40, and the right end 32A of the lower bar 32 is disposed within the lower back slot 54. The bars 31 and 32 are essentially completely enclosed within the four sides of the slots 53, (not shown), 54, and (not shown).

Running perpendicular to the upper and lower bars 31 and 32 are a plurality of wires 34 with a support bar (not shown), which is preferably substantially rectangular (but may be of another shape), disposed parallel to the wires 34 and located somewhere between the wires 34 to act as a structural support for the screen 10. The wires 34 are preferably welded to the front end of the bars 31 and 32, but may be rigidly connected to the bars 31 and 32 in any manner known to those skilled in the art. The wires 34 are engulfed within a back end 71 of the right end frame 50 and a back end (not shown) of the left end frame 40.

Figure 4:
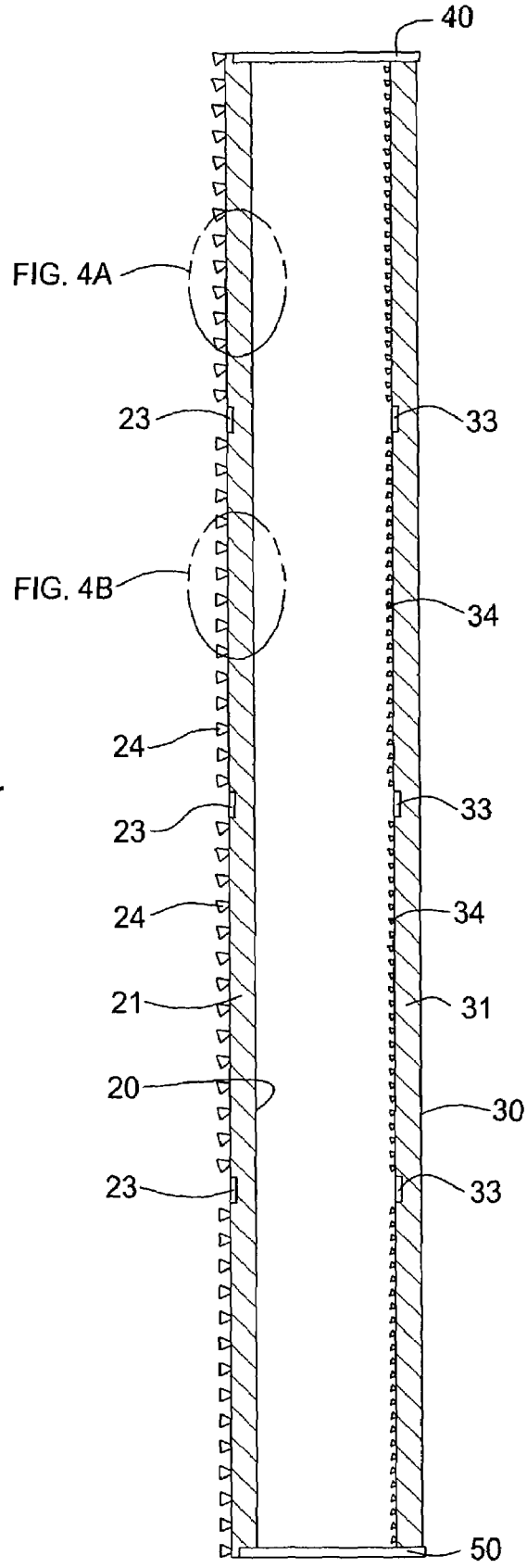
FIG. 4 is a cross-sectional view of a preferred embodiment of an architectural screen of the present invention.
Figure 4A:
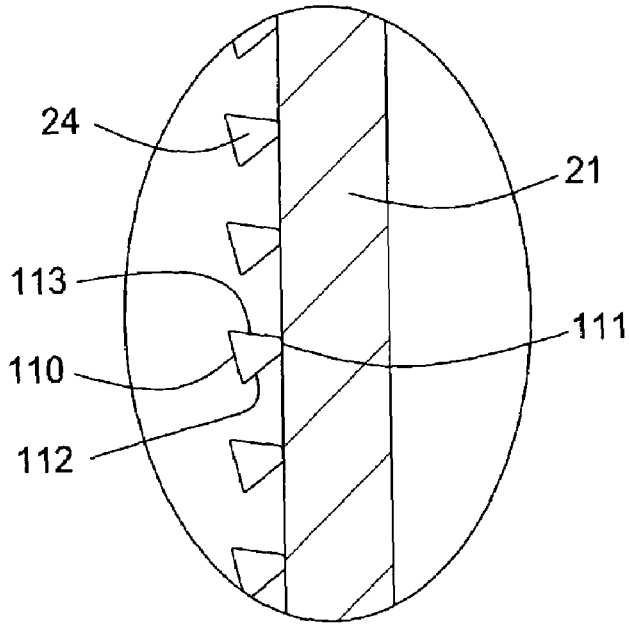
FIG. 4A is a cross-sectional view of a portion of FIG. 4.
Figure 4B:
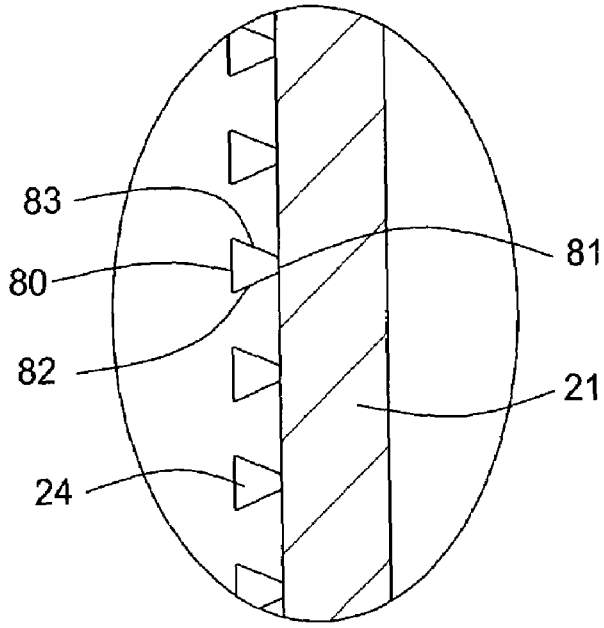
FIG. 4B is a cross-sectional view of a portion of FIG. 4.

The wires 24 and 34 are preferably shaped as shown in FIG. 4A or FIG. 4B. FIGS. 4A and 4B show a cross-section of one of the plurality of wires 24 connected to the upper bar 21. This discussion regarding the shapes of the wires 24 applies equally to the shapes of the wires 34. The cross-sections of the wires 24 are shown as generally trapezoidal in shape. While the cross-sections of the wires 24 shown in FIGS. 4A and 4B are generally trapezoidal-shaped, any other shape which creates the desired visual effect when used with the other features of the present invention is contemplated. In FIG. 4B, the wires 24 are symmetrical and possess top surfaces 80 which are parallel to bottom surfaces 81. The top surface 80 is longer in length than the bottom surface 81. A first side 82 and a second side 83 are located between the top surface 80 and the bottom surface 81. The first side 82 and the second side 83 are angled outward from the bottom surface 81 to connect from the bottom surface 81 to the top surface 80, so that the wire 24 possesses four sides 80, 81, 82, and 83. The bottom surface 81 of the wire 24 is welded to an outer face of each bar 21, 22, 31, 32. Instead of each wire 24 being essentially triangular-shaped so that it comes to a point at its bottom surface 81 for installation on the bars 21, 22, 31, 32, each wire 24 has a blunt surface as its bottom surface 81 for mounting to the bars 21, 22, 31, 32 along its length.

FIG. 4A shows an alternate embodiment of the shape of the wires 24, where the wires 24 are asymmetrical in cross-section. In FIG. 4A, top surfaces 110 of the wires 24 are connected at one end to first sides 112 of the wires 24 and at the other end to second sides 113 of the wires 24. At the opposite end from the top surfaces 110, the first sides 112 and second sides 113 are connected to bottom surfaces 111 of the wires 24. The bottom surfaces 111 of the wires 24 are welded or connected by some other means known by those skilled in the art to the bars 21, 22, 31, or 32. Looking at one of the wires 24, with respect to an axis extending from the end where the first surface 112 and the bottom surface 111 connect, the axis being parallel to the top surface 110 of the wire 24, the bottom surface 111 preferably extends away from the axis at a 15 degree angle. Other angles have been discovered to have similar reflective properties as result with the 15 degree angle, and other angles of the bottom surface 111 are contemplated for use in the wires 24 of the present invention. The top surface 110 of the wire 24, when the bottom surface 111 is at a 15 degree angle with respect to the axis described above, will be oriented at a 15 degree angle with respect to the bar 21, 22, 31, or 32, as well as the front and/or back panel 20, 30. The angle of the top surface 110 of the wires 24 with respect to the rest of the screen 10 produces the desired reflective properties when employing the light emitters 56, (not shown). By controlling the angle of the bottom surface 111, the angle of the reflected surface when using the light emitter 56, (not shown) may be controlled, thus creating the desired aesthetic effect of the screen 10. Controlling the angle between the bottom surface 111 and the top surface 110 of the wire 24 results in the desired angle between the top surface 110 and the bars 21-22 in the final product of the screen 10. The length of the top surface 110 desired determines the angle at which the first and second sides 112 and 113 exist with respect to the top surface 110. Controlling the angles and the length of the top surface 110 defines the appearance of the screen 10.

Other shapes of the wires 24 and 34 are contemplated for use in creating the visual effect with the screen 10 of the present invention. Specifically, the wires may be circular or may possess any number of sides. It is also contemplated that the bottom surface 81 or 111 may be longer than the top surface 80 or 110. In this side, the longer surface is welded against the bars 21-22, 31-32.

In FIGS. 4A and 4B, it is evident that the edges of the wires 24 (where the sides of the wires 24 meet) are substantially rounded rather than distinctly pointed. To enhance reflective properties of the wires 24, sandblasting, glass bead blasting, polishing, or sanding of some or all of the top surface 80, 110, first side 82, 112, and/or second side 83, 113 may be accomplished by any method known to those skilled in the art. Some or all of the above surfaces may also be altered to possess a buffed or matte finish. Specifically, the surfaces may be blasted by shooting glass beads or sand out of an abrasive gun to create a matte finish or may be blasted by any other substances or methods known by those skilled in the art. Other finishing techniques contemplated for use in the present invention to create the desired visual effect include but are not limited to polishing or sanding. In the alternative, an epoxy coating or paint coating may be added to select surfaces of the wires 24 to alter visual properties of the screen 10. Selectively controlling the finish of the faces 80, 110, 82, 112, 83, 113 creates the desired reflectivity of the wires 24 under various lighting conditions.

In a particularly preferred embodiment of the present invention, portions of the screen 10 have asymmetrical wires 24, 34 connected to the bars 21-22, 31-32 and other portions of the screen 10 have symmetrical wires 24, 34 connected to the bars 21-22, 31-32 to create a desired visual effect when used with the light emitter 56, (not shown). FIG. 4 depicts a preferred embodiment using the alternating orientations of the wires 24, 34 on the bars 21, 31, 22, 32.

In the embodiment of FIG. 4, wires 24 having a larger cross-sectional area are disposed on the front panel 20, while the wires 34 having a smaller cross-sectional area are disposed on the back panel 30. Support bars 23 and 33 are disposed between sections of wires 24 and 34 along the length of the bars 21-22, 31-32, running parallel to the wires 24, 34. Altering the orientation of the wires 24, 34 along the length of the screen 10 produces the desired reflectivity. In FIG. 4, the orientation of the wires 24 is altered in sections separated by the support bars 23 along the horizontal length of the bars 21 and 22, so that in one section the wires 24 are asymmetrical in cross-section and the top surfaces 80 of the wires 24 are at an angle with respect to the bars 21 and 22 (see FIG. 4A), then in the next section the wires 24 are symmetrical in cross-section and the top surfaces 80 are substantially parallel to the bars 21 and 22 (see FIG. 4B).

The wires 34 of the back panel 30 are smaller in cross-sectional area and oriented in a different pattern along the bars 31-32 than the wires 24 of the front panel 20 in the embodiment shown in FIG. 4. In this embodiment, the wires 34 are oriented in sections at alternating angles with respect to the bars 31-32, e.g., 15 degree angles oriented toward the right end frame 50 in one section, then 15 degree angles oriented toward the left end frame 40 in the next section. The support bars 33 separate the sections of the various orientations of the wires 34. FIG. 4 shows a preferred embodiment of the present invention, but any alteration in the orientation or finish of the wires 24, 34 and any combination of alterations is contemplated for use in the present invention.

In a particularly preferred embodiment, the symmetrical as well as the asymmetrical wires 24 have a buffed finish on their top surfaces 80. The bottom surfaces 81 of the asymmetrical wires 24 are angled with respect to the top surfaces 80 so that the top surfaces 80 exist at approximately a 15 degree angle with respect to the bars 21-22. Glass beads are expelled from a gun through sandblasting to the corner radiuses of the wires 34 between the top surfaces 110 and the first sides 112 and/or second sides 113 of the wires 34 to produce a matte finish. The bottom surfaces 111 of the asymmetrical wires 34 are angled with respect to the top surfaces 110 so that the top surfaces 110 exist at approximately a 15 degree angle with respect to the bars 31-32. The length of the top surfaces of the wires 24 is approximately double the length of the top surfaces of the wires 34. The corner radiuses of the wires 24 and 34 are rounded to obtain reflectivity.

To construct the screen 10, the wires 24 and 34 are shaped so that the bottom surfaces 81 and 111 are at the angle with respect to the top surfaces 80 and 110 at which the top surfaces 80 and 110 are desired to exist after mounting the bottom surfaces 91 and 111 to the bars 21-22, 31-32. The wires 24 are mounted to the bars 21-22 at their points of intersection, and the wires 34 are mounted to the bars 31-32 at their points of intersection. The bars 21-22 are inserted into the left end frame 40. The bars 31-32 are inserted into the right end frame 50. Next, the bars 21-22 are inserted into the right end frame 50 while the bars 31-32 are inserted into the left end frame 40. In the alternative, the bars 21-22 may first be inserted into the right end frame 50 (see FIG. 3), and the bars 31-32 may first be inserted into the left end frame 40.

Figure 5:
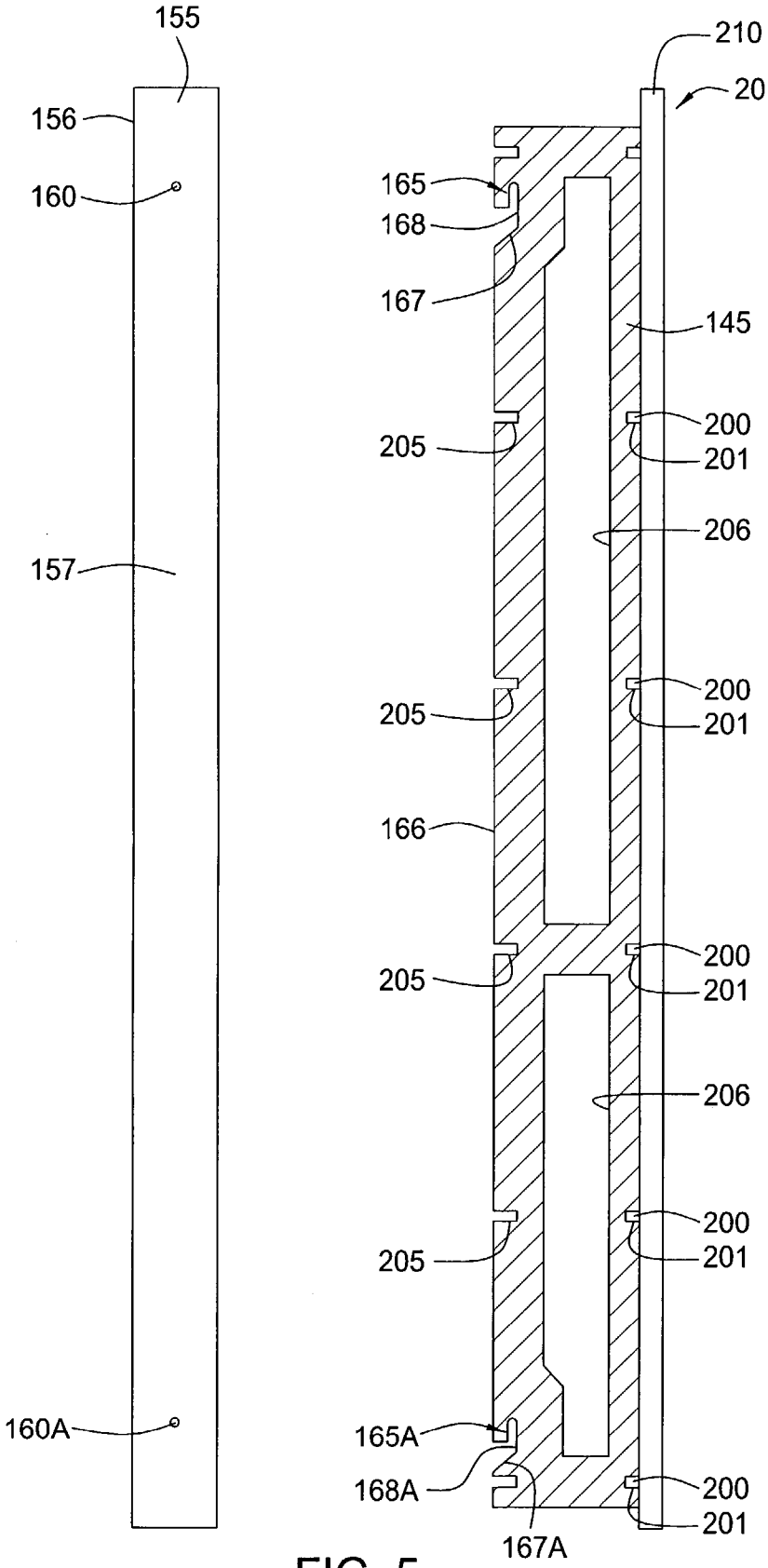
FIG. 5 is a sectional view of a screen panel of the present invention having a slot therein for hanging onto a support frame with a connecting member extending therefrom.

FIGS. 5-8 illustrate a method of mounting at least one of the panels 20 or 30 of the screen 10 of the present invention to a surface such as a wall. The wire on the panels 20 or 30 may comprise any type of wire known by those skilled in the art, including wedge-wire or filter wire. The surface may be horizontal or vertical with respect to the floor, or at various angles in between horizontal and vertical. Referring to FIG. 5, at least one support frame 155 is mounted to the surface on an inner side 156. The support frame 155 has at least one connecting member 160 such as a pin extending from its first side 157. Preferably, a support frame 155A located across from the support frame 155 is also mounted to the surface. The support frame 155A has at least one connecting member (not shown), the second connecting member extending from a first side 157A of the support frame 155A. The first sides 157, 157A of the support frames 155, 155A are substantially perpendicular to the surface (e.g., the wall) and the inner sides 156, 156A of the support frame 155, so that the connecting members 160, (not shown) run parallel to the surface. Connecting members 160A and (not shown) may also be mounted on the first sides 157, 157A of the support frames 155, 155A below the connecting members 160, (not shown) to further secure the panel 20 or 30 to the surface.

The support frames 155, 155A are essentially brackets which are connected to the surface. The brackets may be adjusted forward and backward, upward and downward, and/or left and right relative to the surface, depending upon the desired location at which to anchor the panels 20 or 30.

In this embodiment, the screen panel 20 (although screen panel 20 is depicted in FIGS. 5-8, the following discussion may apply equally to screen panel 30) has a frame 145 on each end of the panel 20 secured by bars 200 within slots 201, the bars 200 having wires 210 welded along the intersection of the wires 210 and the bars 200, much like the bars 21-22 and 31-32 with wires 24, 34 housed in the slots of the left and right end frames 40 and 50 above-described in relation to FIGS. 1-4. Each frame 145 has at least one angled slot 165 located therein. Each frame 145 has four sides, and the angled slot 165 is disposed within a side 166 of the frame 145 located closest to the support frames 155, 155A. The angled slot 165 is open at the edge of the side 166. A first portion 167 of the angled slot 165 is angled outward and upward longitudinally and with respect to the side 166. The first portion 167 is at a slight angle to increase the clamping force of the angled slot 165 on the connecting member 160. A second portion 168 of the angled slot 165 then extends upward longitudinally parallel with the side 166 of the frame 145. An angled slot (not shown) is also preferably located in a portion (not shown) of the frame 145 located across from the portion having the angled slot 165. Preferably, the angled slots 165, (not shown) are parallel to one another, so that the connecting members 160, (not shown) may fit within each angled slot 165, (not shown). The frames 145 may possess any number of angled slots 165, 165A which may mate with any number of connecting members 160, 160A, (others on 155A not shown) extending from the support frames 155, 155A. In one embodiment, each frame 145 has two angled slots therein located near the upper and lower portions of each frame 145, and connecting members extend from four mating portions of the support frames 155, 155A.

Within each frame 145 are the bars 200 and the wires 210. The wires 210 may be shaped and angled as described above in relation to FIGS. 1-4B. The wires 210 and the bars 200 are perpendicular with respect to one another, but may possess any orientation with respect to the frames 145 (the wires 210 may be vertical or horizontal with respect to the side 166 of the frame 145, and so may the bars 200). The frame 145 which is shown in FIG. 5 has slots 205 located therein, which may be standard construction for the screen panels 20 and 30 so that screen panels 20 and 30 may be connected to one another if desired by bars (not shown) with wires on them inserted into the slots 205, then the screen panel closest to the support frames 155, 155A may be mounted on the support frames 155, 155A. In this way, multiple layers of screen panels 20 and 30 may be hung from the support frames 155, 155A, such as the layered screen 10 as described above in relation to FIGS. 1-4. Each frame 145 of the screen panel 20 or 30 is also shown with a light slot 206 therethrough, which may be used to emit light as described above in relation to FIGS. 1-4. It is also contemplated that a screen panel 20 or 30 having a frame 145 with no slots 205 or light slot 206 in the frame 145 may be hung from the surface by use of the connecting members 160, (not shown), 160A, (not shown) of FIGS. 5-8.

Figure 6:
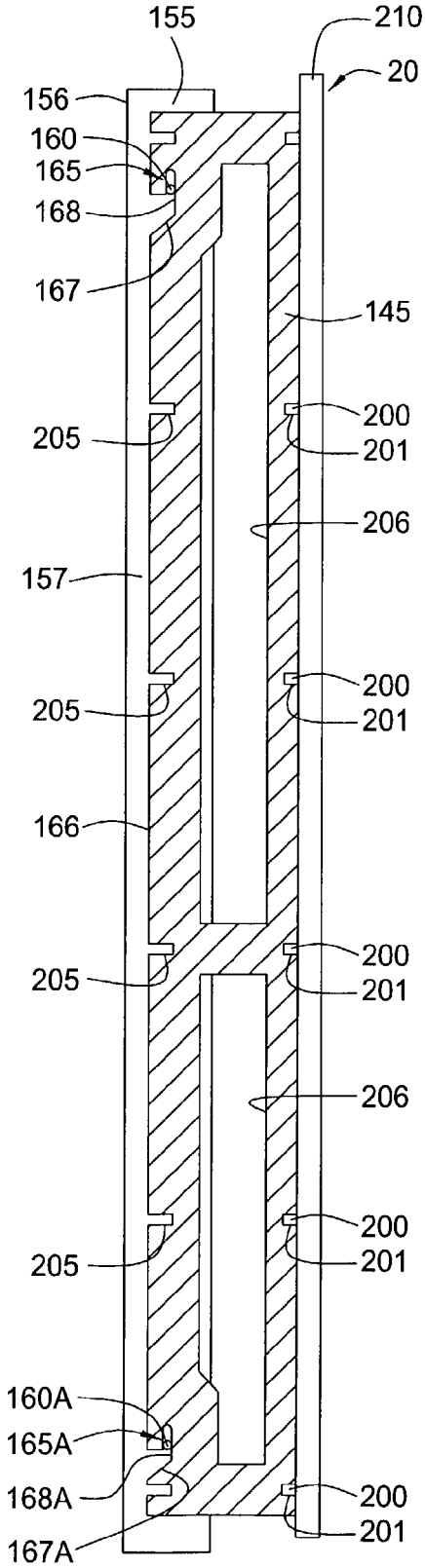
FIG. 6 is a sectional view of the screen panel of FIG. 5 where the connecting member is inserted into the slot and the panel is moved toward the support frame so that the connecting member moves within the slot.
Figure 7:
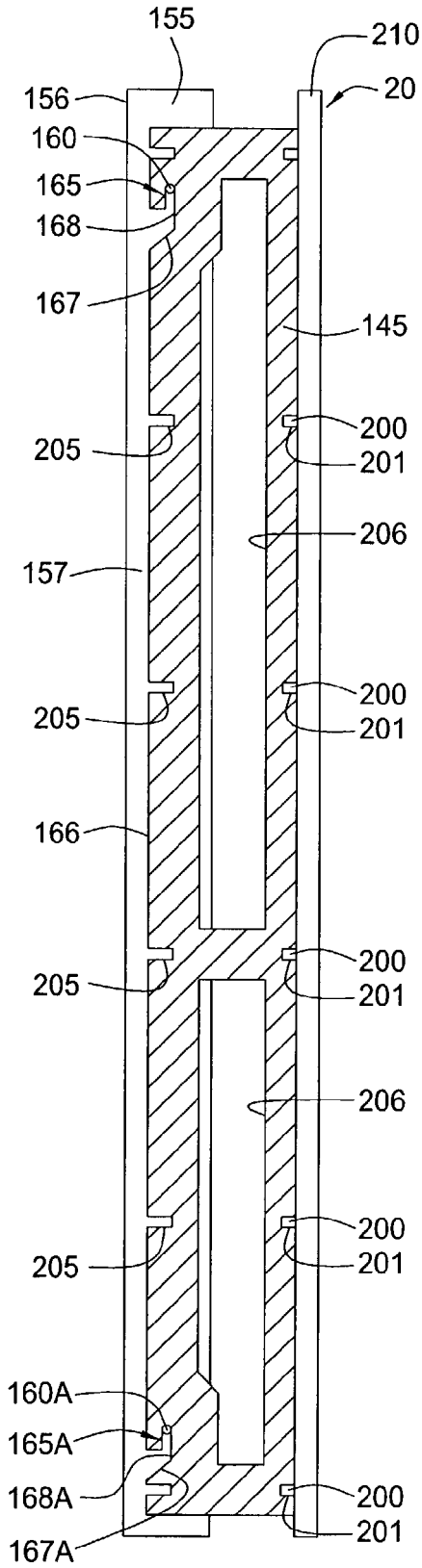
FIG. 7 is a sectional view of the screen panel of FIG. 5 where the panel is lowered so that the slot is lowered onto the connecting member, and the connecting member is thereby secured within the slot.
Figure 7A:
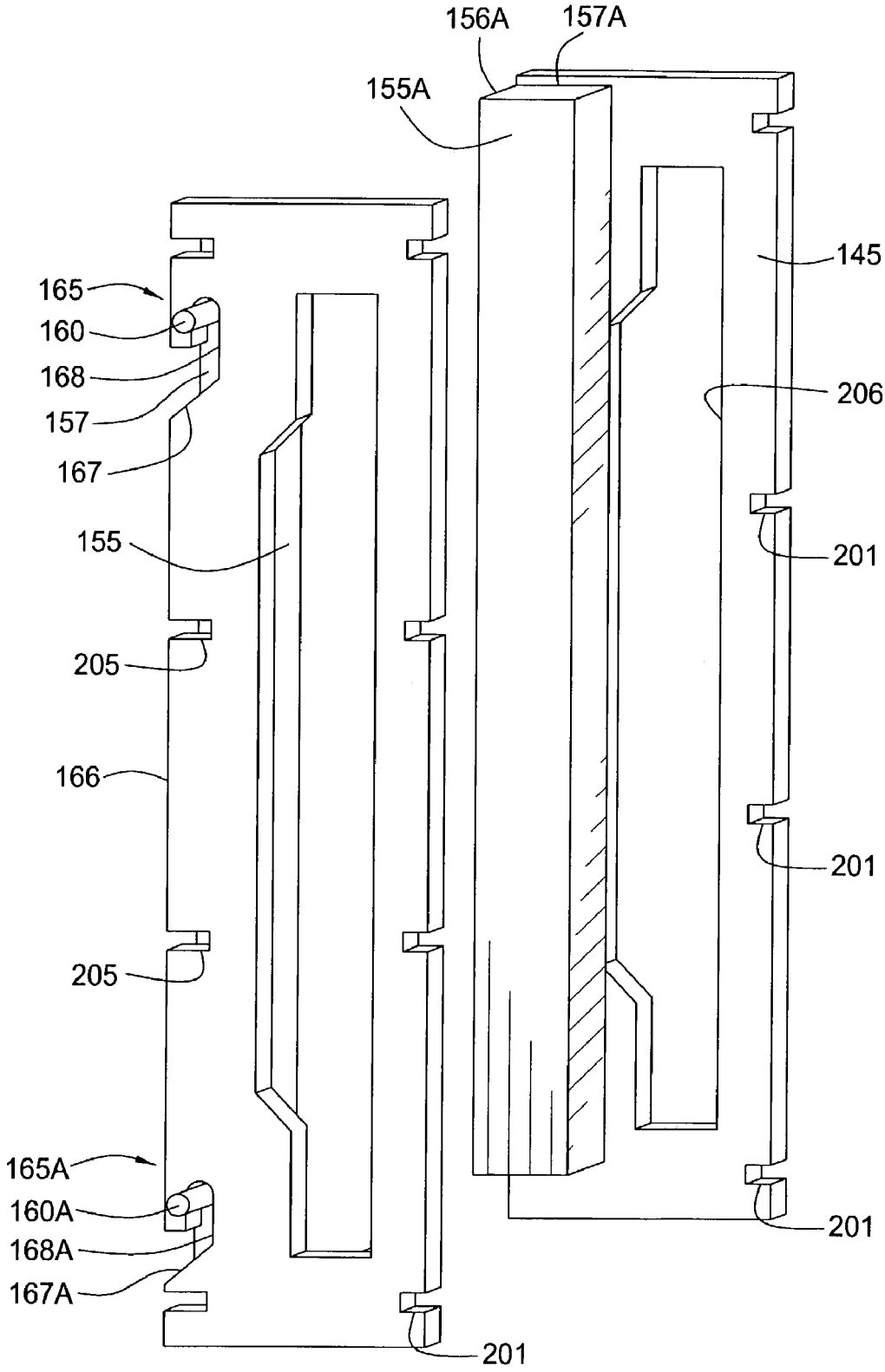
FIG. 7A is a partial front view of the screen panel of FIG. 7.

In operation, the, support frames 155, 155A are mounted to the surface. The panel 20 is then located so that the angled slots 165, 165A (other side not shown) are in front of the respective connecting members 160, 160A (other side not shown) with which they are designed to mate. Next, the panel 20 is moved toward the support frames 155, 155A so that each connecting member 160, 160A (other side not shown) is placed within the open edge of each angled slot 165, 165A (other side not shown). The panel 20 or 30 is first slid horizontally so that each connecting member 160, 160A (other side not shown) moves along the first portion 167, 167A (other side not shown) of the angled slot path, as shown in FIG. 6. Then the panel 20 or 30 is lowered vertically so that each connecting member 160, 160A (other side not shown) is seated securely within the second portion 168, 168A (other side not shown) of each angled slot 165, 165A (other side not shown), as shown in FIGS. 7 and 7A. The connecting members 160, 160A (other side not shown) within the angled slots 165, 165A (other side not shown) act as an anchor for the screen panel 20. The weight of the screen panel 20 holds the panel 20 in place relative to the surface. In this way, the screens 10 are easily removable, but are held securely in place until removed.

The support frames 155, 155A and the panel 20 or 30, along with each frame 145, are often constructed of different materials with various degrees of thermal expansion when exposed to heat or cooling. The angled slots 165, 165A, and (other side not shown) allow room for thermal expansion of the support frames 155, 155A and the panel 20 or 30 relative to one another in all three dimensions.

Figure 8:
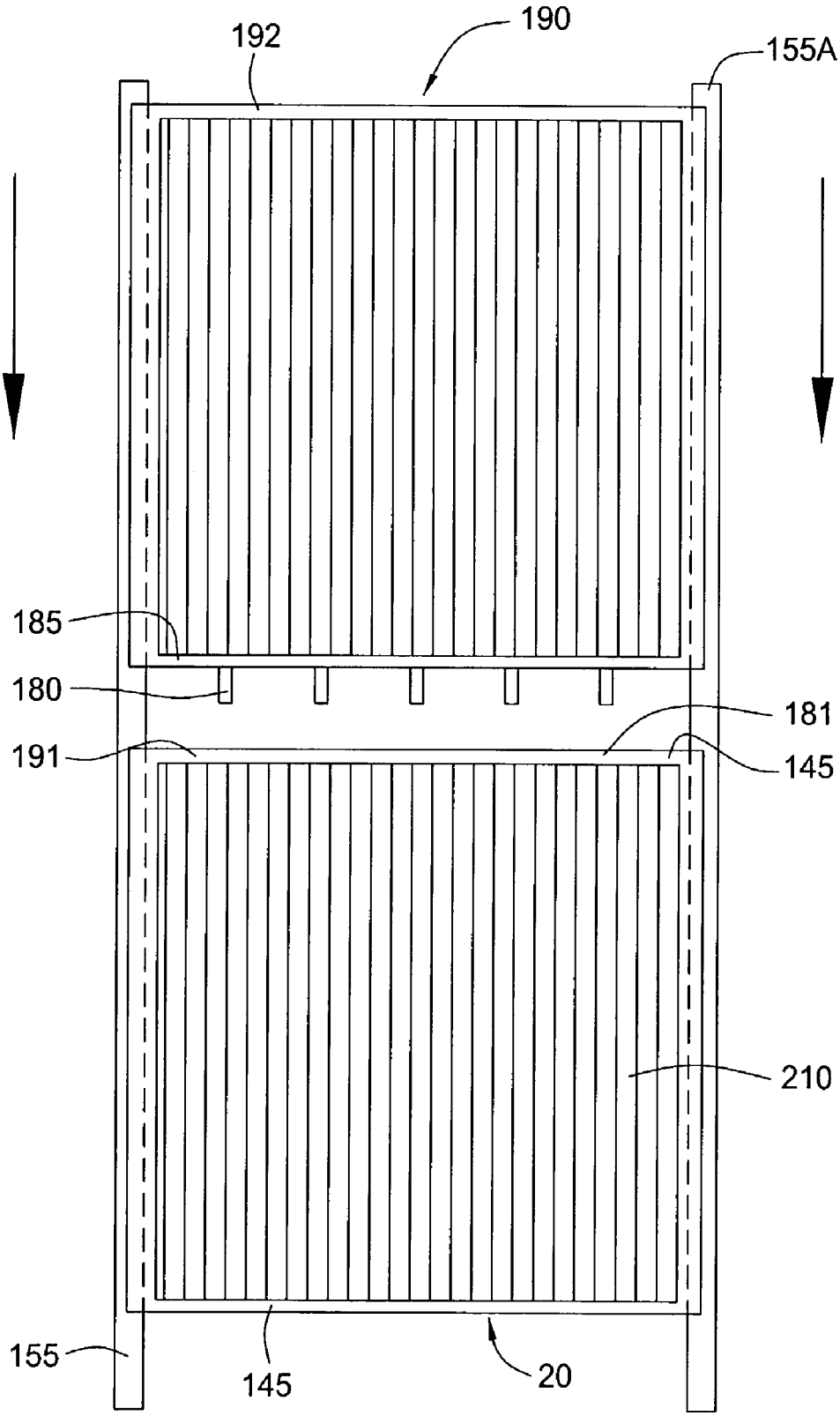
FIG. 8 is a sectional view of two screen panels of the present invention for connection together by use of locating pins in slots.

FIG. 8 shows an embodiment of the present invention where multiple panels 20 and 190 are connected to one another. This embodiment shows a different embodiment of the panels 20 and 190, where the frames 145 and 192 are not merely on the ends of the panels 20 and 190, but are instead welded or connected by the bars to reside all the way around the perimeters of the panels 20 and 190. The panel 20 is first placed upon the support frames 155, 155A as described above in relation to FIGS. 5-7A. In this embodiment, one or more slots 181 are disposed on a side 191 of the frame 145 around the perimeter of the panel 20. A panel 190 with one or more locating pins 180 for placing within the slots 181 located on a side 185 of a frame 192 around the perimeter of the panel 190 possesses substantially similar angled slots (not shown) to those in panel 20 (see FIGS. 5-7A) within the frame 192 of the panel 190. The locating pins 180 and slots 181 may be located on and within any sides of the panels 20 and 190 which it is desired to mate with one another. The locating pins 180 may be straight or tapered. The support frames 155, 155A have connecting members (not shown) above the connecting members 160, 160A (other side not shown) for mating with the angled slots (not shown) in the frame 192.

In use, the panel 20 is secured to the support frames 155, 155A as described above in relation to FIGS. 5-7A. Next, the panel 190 is moved toward a portion of the support frames 155, 155A above the panel 20 so that the connecting members (not shown) are placed within the angled slots (not shown) of the panel 190. The panel 190 is slid horizontally so that the, connecting members (not shown) slide along the first portions (not shown) of the angled slots (not shown), then downward along the second portions (not shown) of the angled slots, as described above in relation to FIGS. 5-7A. As the panel 190 is moved downward, the connecting members are securely located within the angled slots to hold the panel 190 in place, while the locking pins 180 are located within the slots 181 to further support the panel 190 and provide end-to-end seal of the panels 20 and 190. Overlapping strips may also be located around the perimeter of the panels 20, 190 to provide an effective seal against unwanted material bypassing the screen panels 20, 190. Furthermore, overlapping strips may be located around the perimeter of one or more of the panels 20, 30, 190 to provide a seal between the panels 20, 30, 190 and the support frames 155, 155A.

The method and apparatus depicted in FIGS. 5-8 and described herein may be utilized not only in mounting the screen 10 which may comprise the wires 24 and 34 oriented and finished as described in relation to FIGS. 1-4A, but may also be utilized in mounting any other type of screen for any other purpose, including but not limited to screens used in hydrocarbon wells and water wells. The mounting method and apparatus may further be used in types of screens other than flat screen panels.

In all of the above embodiments, the bars 21-22, 31-32, 200 for use in the present invention may be either shaped (including rectangular) or round. The screen panels 20, 30, 190, although shown in FIGS. 1-8 as substantially rectangular, may be of any shape known in the art, including trapezoidal, triangular, or round. The support frame 155 may also be of any shape which may accommodate connecting members 160, 160A, (not shown) extending therefrom. The angled slots 165, 165A, (not shown) may be slightly angled, tapered, or formed in any other configuration which allows clamping of the slots 165, 165A, (not shown) onto the connecting members 160, 160A, (not shown). When referring to "left" and "right", "front" and "back", "up" and "down", and other directions with regards to the above figures, the above description should be construed only as representing the relationship of components to one another and not literal directions.

While the foregoing is directed to embodiments of the present invention, other and further embodiments of the invention may be devised without departing from the basic scope thereof, and the scope thereof is determined by the claims that follow.

The invention claimed is:

1. A screen, comprising:

a first substantially planar panel having:

a first and a second end support frames;

at least one first panel bar, wherein the first panel bar is disposed intersecting the first and second end support frames; and a first set of wires intersecting the at least one first panel bar at intervals, wherein each of the wires is substantially trapezoidal in cross-section and at least one of the wires is connected to the at least one first panel bar at a first angle and at least one other of the wires is connected at a second angle, to alter reflectivity of the screen.

2. The screen of claim 1, wherein the first angle is about a fifteen degree angle.

3. The screen of claim 1, further comprising:

a second panel parallel to the first panel, having:

at least one second panel bar disposed within the first and second end support frames, and a second set of wires intersecting the at least one second panel bar at intervals, wherein each of the second set of wires is trapezoidal in cross-section.

4. The screen of claim 3, wherein each of the first set of wires comprises a larger cross-sectional area than each of the second set of wires.

5. The screen of claim 3, wherein at least one of the second set of wires is angled to alter reflectivity of the screen.

6. The screen of claim 3, wherein a light source shines light through a light slot In the end support frames.

7. The screen of claim 1, wherein the finish of at least one of the first set of wires is altered for reflectivity.

8. The screen of claim 1, wherein corner radiuses of each of the first set of wires are controlled to alter reflectivity.

9. The screen of claim 1, wherein the angles are created by providing an angle in a surface of each of the wires connected to the at least one first panel bar with respect to a surface of each of the first set of wires opposite the at least one first panel bar.

10. The screen of claim 1, wherein the angles are created by providing an asymmetrical cross-section for each of the first set of wires.

11. The screen of claim 1, further comprising a light source.

12. The screen of claim 11, wherein the light source comprises one or more light emitters attachable to the end support frames.

13. The screen of claim 1, wherein a first end of the first panel bar is disposed intersecting the first end support frame and a second end of the first panel bar is disposed intersecting the second end support frame.

14. The screen of claim 1, wherein the first end support frame is separated from the second end support frame.

15. The screen of claim 1, wherein the first end support frame is separated from the second end support frame by a distance equal to the length of the first panel bar minus the thicknesses of the first and second end support frames.

16. The screen of claim 1, wherein the first or the second end support frame is parallel to the first set of wires.

17. The screen of claim 1, wherein a longitudinal axis of the first or the second end support frame is parallel to the first set of wires.

18. A screen for reflecting light comprising:

a first panel having:

a plurality of non-intersecting wires, the wires each having at least one substantially flat surface for reflecting light;

one or more bars connecting the wires in a substantially planar configuration, wherein at least one of the plurality of non-intersecting wires is connected with the one or more bars such that the flat surface is at an angle relative to the planar configuration; and a light source for reflecting light off the plurality of non-intersecting wires.

19. The screen of claim 18, wherein at least one wire is connected to the one or more bars so that the substantially flat surface is parallel to the bar and at least one other wire is connected to the one or more bars such that the flat surface is at an angle relative to the bar.

20. The screen of claim 18, wherein the cross section of the wires is substantially trapezoidal.

21. The screen of claim 18, further comprising one or more end frames for supporting the bar.

22. The screen of claim 21, further comprising the end frame supporting a second panel.

23. The screen of claim 22, wherein the second panel is of similar configuration to and parallel to the first panel.

24. The screen of claim 23, where the one or more frames have a light slot for reflecting light off the second panel.

25. The screen of claim 24, further comprising a light emitter connected to the light slot.

26. The screen of claim 18, wherein the angle is not 0° and not 90°.

27. The screen of claim 18, wherein the angle is about 15°.

28. The screen of claim 18, wherein the at least one of the plurality of wires connected with the one or more bars such that the flat surface is at an angle relative to the planar configuration is substantially disposed within the planar configuration.

* * * * *